United States Patent [19]

Sasaki

[11] Patent Number: 4,763,623

[45] Date of Patent: Aug. 16, 1988

[54] DEVICE FOR CONTROLLING THE IDLING OPERATION OF AN INTERNAL COMBUSTION ENGINE

[75] Inventor: Takeo Sasaki, Himeji, Japan

[73] Assignee: Mitsubishi Denki Kabushiki Kaisha, Japan

[21] Appl. No.: 48,606

[22] Filed: May 11, 1987

[30] Foreign Application Priority Data

May 12, 1986 [JP] Japan ..... 61-108108
May 12, 1986 [JP] Japan ..... 61-108109

[51] Int. Cl.[4] ..... F02D 9/02
[52] U.S. Cl. ..... 123/339; 123/349
[58] Field of Search ..... 123/339, 349, 480, 492; 73/118, 204, 494

[56] References Cited

U.S. PATENT DOCUMENTS

| | | | |
|---|---|---|---|
| 4,406,262 | 9/1983 | Ikeura | 123/349 |
| 4,457,275 | 7/1984 | Hosokai et al. | 123/349 |
| 4,457,276 | 7/1984 | Ueda et al. | 123/349 |
| 4,594,987 | 6/1986 | Wataya et al. | 123/494 |
| 4,612,333 | 5/1987 | Martel | 123/339 |
| 4,649,878 | 3/1987 | Otobe et al. | 123/339 |
| 4,672,936 | 6/1987 | Abe | 123/339 |
| 4,681,075 | 7/1987 | Yamato et al. | 123/339 |
| 4,683,539 | 7/1987 | Kanno et al. | 364/431.05 |
| 4,694,806 | 9/1987 | Wataya et al. | 123/494 |
| 4,706,634 | 11/1987 | Nishikawa et al. | 123/492 |

FOREIGN PATENT DOCUMENTS 53-45861 12/1978 Japan .

*Primary Examiner*—Raymond A. Nelli
*Attorney, Agent, or Firm*—Leydig, Voit & Mayer

[57] ABSTRACT

A device for controlling idling operation of an internal combustion engine comprising an actuator operatively connected to a throttle valve for controlling the opening degree of the throttle valve during engine idling operation, an actuator position sensor for sensing an operating position of the actuator, a first control unit adapted to receive output signals from an engine RPM sensor, a water temperature sensor which senses the temperature of engine cooling water and the actuator position sensor to control the operation of the actuator such that the opening degree of the throttle valve is adjusted to an appropriate level to maintain the RPMs of the engine during idling at a predetermined value corresponding to the sensed temperature of the cooling water, and a second control unit independently operated from said first control unit to control the operation of the actuator in accordance with the operating position of the actuator and the temperature of the cooling water so as to limit the operating position of the actuator and thereby limit the RPMs of the engine to the predetermined value corresponding to the sensed temperature of the cooling water notwithstanding a higher value of RPMs being called for by the first control unit.

3 Claims, 4 Drawing Sheets

DEVICE FOR CONTROLLING THE IDLING OPERATION OF AN INTERNAL COMBUSTION ENGINE

BACKGROUND OF THE INVENTION

1. Field of the Invention

The present invention relates to a device for controlling the idling operation of an internal combustion engine which is adapted to control the number of engine revolution per unit time (hereinafter referred to as RPM) during idling to a desired value by changing the opening area of an intake passage in accordance with the temperature of engine cooling water.

2. Description of the Prior Art

In general, a device for controlling the idling operation of an internal combustion engine by changing the opening area of an intake passage has been known which employs an acutator for changing the closed-side stop position of a throttle valve disposed in the intake passage to control the RPM of the engine during idling to a desired value. In this type of idling operation cntrolling device, the RPMs of the engine is sensed by a RPM sensor and input to a control unit which compares the actual RPMs thus sensed with a preset object value so that the engine is controlled in a feedback manner to make the RPMs converge into the object value. Also, an actuator position sensor is provided to sense the position of the actuator and the actuator position thus sensed is input to the control unit so as to control the actuator position to a preset objected position so that the opening degree of the throttle valve, which is operated by the actuator, is controlled in a feedback manner. Further, in order to perform the fast-idling operation of the engine, the objected position of the actuator is preset in a manner such that the actuator position and hence the throttle valve poition comes to a relatively large opening degree when the temperature of the engine cooling water is low as illustrated by a solid line curve A in FIG. 5.

In the above-described idling operation controlling device, there is no problem when the control unit for controlling the actuator in the above manner operates normally without any failure, but if the control unit has failed so that an abnormal signal is output to the actuator to cause it to open excessively from the preset objected position in spite of the fact that the temperature of the engine cooling water becomes high after the warming-up operation of the engine has been completed, the RPMs of the enigne during idling is abnormally increased to a dangerous level.

SUMMARY OF THE IVENTION

In view of the above, the present invention has the objective of eliminating the above-mentioned problems of the prior art, and has for its main object the provision of a novel and improved device for controlling the idling operation of an internal combustion engine which can prevent any abnormal increase in RPMs during the idling of the engine even if the control unit outputs an abnormal signal to the actuator so as to cause the throttle valve to excessively open from the preset position.

In order to achieve the above object, according to one aspect of the present invention, there is provided a device for controlling idling operation of an internal combustion engine comprising:

an engine RPM sensor which senses rotational speed in RPMs of an engine and generates an output signal representative thereof;

a water temperature sensor which senses temperature of cooling water for the engine and generates an output signal representative thereof;

a throttle valve in an intake passage of the engine which controls flow rate of intake air sucked into the engine;

an actuator means operatively connected to the throttle valve for controlling the opening degree of the throttle valve during the idling operation of the engine;

an actuator position sensor which senses an operating position of the actuator means and generates an output signal representative thereof;

a first control means connected to receive output signals from the engine RPM sensor, the water temperature sensor and the actuator position sensor and calling for the operation of the actuator means such that the opening degree of the throttle valve is adjusted to maintain the RPMs of the engine during idling of a predetermined value corresponding to the sensed temperature of the cooling water;

and a second control means operable independently of the first control means to control the operation of the actuator means in accordance with the operating position of the actuator means and the temperature of the cooling water so as to limit the operating position of the actuator means and thereby limit the RPMs of the engine to the predetermined value corresponding to the sensed temperature of the cooling water notwithstanding a higher value of RPMs being called for by the first control means.

The second control means includes:

a position-limiting means connected to receive output signals from the water temperature sensor and the actuator position sensor to generate a limit signal to the first control means when the operating position of the actuator position sensor exceeds a predetermined value; and an actuator-stopping means operatively connected to the position-limiting means for generating a control signal to stop the operation of the actuator means on the basis of the limit signal.

According to another aspect of the present invention, there is provided a device for controlling idling operation of an internal combustion engine comprising:

an engine RPM sensor which senses rotational speed in RPMs of an engine and generates an output signal representative thereof;

a water temperature sensor which senses temperature of cooling water for the engine and generates an output signal representative thereof;

a throttle valve in an intake passage of the engine which controls flow rate of intake air sucked into the engine;

an actuator means operatively connected to the throttle valve for controlling the opening degree of the throttle valve during the idling operation of the engine;

an actuator position sensor which senses an operating position of the actuator means and generates an output signal representative thereof;

a control means connected to receive output signals from the engine RPMs sensor, the water temperature sensor and the actuator position sensor and calling for the operation of the actuator means such that the opening degree of the throttle valve is adjusted to maintain the RPMs of the engine during idling of a predetermined value corresponding to the sensed temperature of the cooling water;

a position-limiting means connected to receive output signals from the water temperature sensor and the actuator position sensor to generate a first limit signal to the control means when the operating position of the actuator position sensor exceeds a first predetermined value and a second limit signal when the operating position of the actuator position sensor exceeds a second predetermined value; and an actuator-limiting means operatively connected to the position-limiting means for generating a control signal to stop the operation of the actuator means in a forward, increased-speed direction on the basis of the first limit signal and for generating a second control signal to stop the operation of the actuator means in a backward, decreased-speed direction on the basis of the second limit signal.

The above and other objects, features and advantages of the present invention will become apparent from the following detailed description of a few presently preferred embodiments of the invention when taken in conjunction with the accompanying drawings.

BRIEF DESCRIPTION OF THE DRAWINGS

FIGS. 1 and 2 relate to a device for controlling the idling operation of an internal combustion engine in accordance with one embodiment of the present invention, in which:

FIG. 1 is a schematic view illustrating the general construction of the same; and FIG. 2 is a diagrammatic view illustrating the time-related change in the actuator position with respect to the output signal of a CPU 102 and the output level of a flip-flop 107 at one (Q) of its output terminals.

FIGS. 3 and 4 relate to a device for controlling the idling operation of an internal combustion engine in accordance with another embodiment of the present invention, in which:

FIG. 3 is a view similar to FIG. 1; and

FIG. 4 is a diagrammatic view illustrating the time-related change in the actuator position with respect to the output signal of a CPU 102, the output level of a flip-flop 107 at one (Q) of its output terminals and the output level of an AND gate 108.

DESCRIPTION OF THE PREFERRED EMBODIMENTS

Now, the present invention will be described in detail with reference to a few presently preferred embodiments thereof as illustrated in the accompanying drawings.

Figure 1:
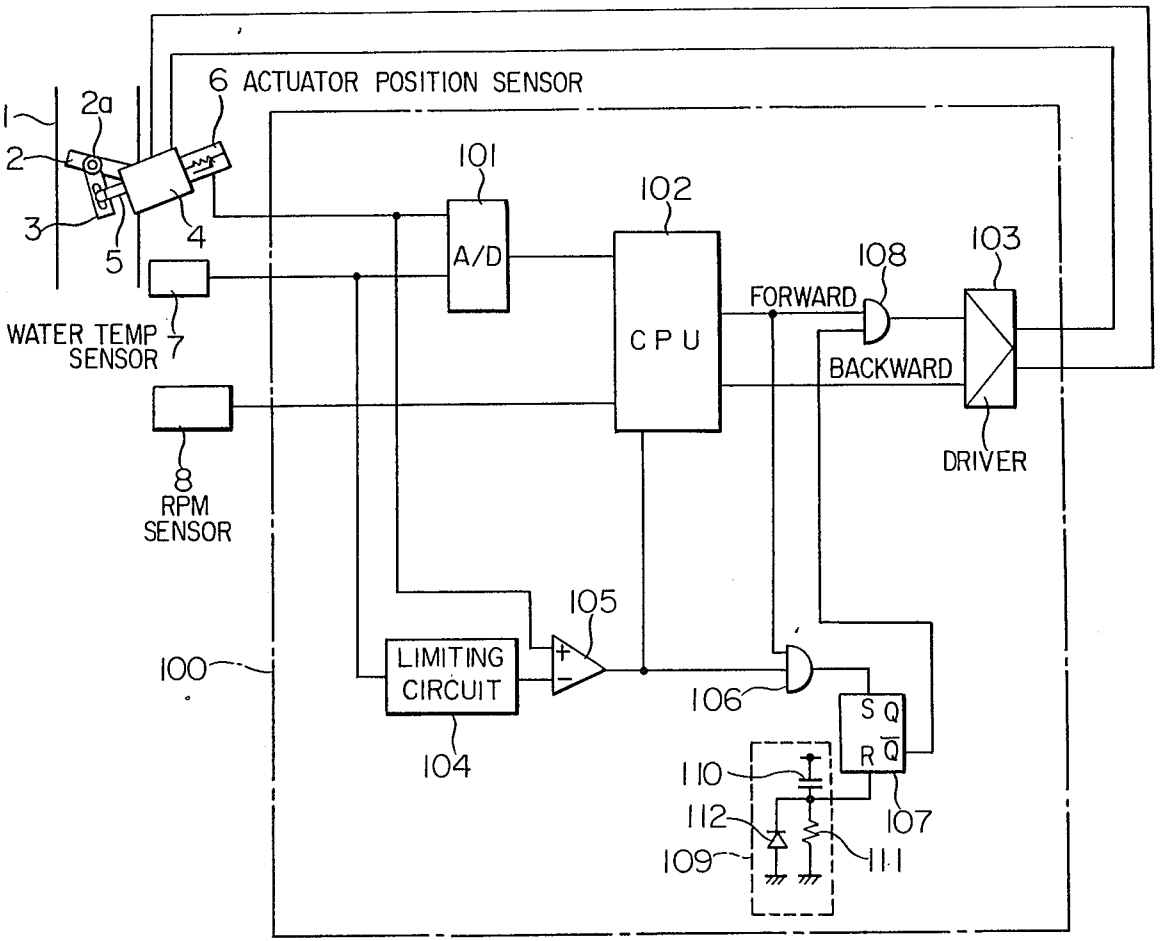

FIG. 1 shows a device for controlling the idling operation of an internal combustion engine in accordance with a first embodiment of the present invention. In FIG. 1 reference numeral 1 designates an intake passage or a carburetor of an internal combustion engine in which a throttle valve is mounted on a shaft 2*a* so as to be rotatable therewith for controlling the flow rate of intake air sucked into an engine proper (not shown). A lever 3 is connected at its one end with the shaft 2a and at its other end with an operation rod 5 of an actuator 4 which employs a DC electric motor. The actuator 4 operates to convert the rotary movement of the motor into a linear movement through the action of an unillustrated appropriate gear so that the operation rod 5 is thereby caused to extend or contract to change the stop position of the throttle valve 2 in its closing state. The operation rod 5 of the actuator 4 is adapted to be in contact with the lever 3 so as to detect the idling operation of the engine when an acceleration pedal (not shown) is not stepped on by an operator. Thus, the actuator 4 also serves as an idling switch for detecting the engine idling operation. An actuator position sensor 6 is provided on the actuator 4 for sensing the extended or contracted position of the actuator rod 5 to generate an output signal in the form of an analog signal representative of the sensed position of the actuator rod 5. A water temperature sensor 7 is provided for sensing the temperature of cooling water for the engine to generate an output signal in the form of an analog signal representative of the sensed cooling water temperature, and an RPM sensor 8 is provided for sensing the rotational speed in RPMs of the engine to generate an output signal in the form of a digital signal representative of the sensed engine RPMs.

Figure 5:
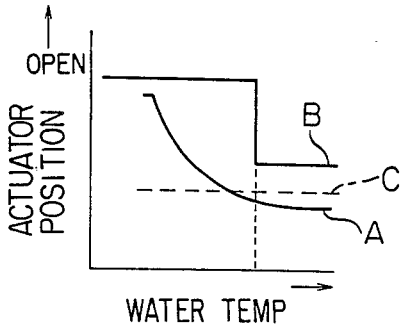
FIG. 5 is a graphic representation illustrating a relationship between the objected value A of the actuator position with respect to the temperature of cooling water according to a conventional idling-operation control device, and the upper limit B the lower limit for the actuator position with respect to the temperature of cooling water according to the present invention.

According to this embodiment, the device for controlling the idling operation of the engine includes a control unit, generally designated by reference numeral 100, which is constructed to receive the output signals from the actuator position sensor 6, the water temperature sensor 7 and the RPM sensor 8 and controls the operation of the actuator 4 on the basis of the information about the position of the actuator rod 5, the temperature of cooling water and the RPMs of the engine obtained therefrom. Now, describing the construction of the control unit 100, the actuator position sensor 6 and the water temperature sensor 7 are connected to a pair of input terminals of an A/D converter 101 which acts to convert the output signals of the sensors 6 and 7 from analog values into digital values which are then input to a first input port of a CPU 102. A second input port of the CPU 102 is connected to the RPM sensor 8 so that the output signal of the sensor 8 in the form of a digital value is input to the CPU 102. The CPU 102 serves to calculate the driving direction and the driving time duration for the actuator 4 based on the output signals from the A/D converter 101 and the information about the engine RPMs obtained from the output signal of the RPM sensor 8, and outputs a forward (or extension) signal or a backward (or contraction) signal to a driver 103 calling for operation of the actuator 4 to obtain increased speed or decreased speed of the engine in order to maintain the predetermined RPMs of the engine for the idling operation thereof. Further, the output signal of the water temperature sensor 7 is input to a limiting circuit 104 in which a prescribed limit level or an upper limit for the extended position of the actuator rod 5 is preset on the basis of the temperature of cooling water, as clearly shown by solid line B in FIG. 5. The limiting circuit 104 determines an appropriate limit level for the actuator rod extended position which corresponds to the sensed temperature of cooling water, and generates an output signal representative of the thus determined actuator rod limit level. The output signal of the limiting circuit 104 is input to a negative (−) input terminal of a comparator 105 of which the positive input terminal (+) is input with the output signal from the actuator position sensor 6 so that the comparator 105 compares the actual position of the actuator rod 5 sensed by the actuator position sensor 6 with the limit level determined by the limiting circuit 104, and sends out an output signal of high level to a third input port of the CPU 102 and one of input terminals of an AND gate 106 if it is determined that the actual position of the actuator rod 5 exceeds the limit level. In this connection, it is to be noted that the CPU 102 is constructed such that upon receipt of the high output signal from the comparator 105, it stops generation of a forward signal if it is generated. The other input terminal of the AND gate 106 is connected to a forward output port of the CPU 102 so as to be input with a forward signal which is output from the CPU 102. The AND gate 106 has an output terminal connected to a set terminal (S) of a S-R flip-flop 107 which has one ($\overline{Q}$) of output terminals connected to one of input terminals of an AND gate 108 of which the other input terminal is connected to the forward output port of the CPU 102 so as to be input with the forward signal therefrom. The reset terminal (R) of the flip-flop 107 is connected to an initialization circuit 109 which includes a capacitor 110, a resistor 111 and a diode 112. The output terminal of the AND gate 108 is connected to one of input terminals of the driver 103 of which the other input terminal is connected to a backward output port of the UPU 102 so as to be input with a backward signal therefrom. Also, the driver 103 has a pair of output terminals connected to the actuator 4 so that as the driver 103 receives a forward signal from the CPU 102 through the AND gate 108 or a backward signal directly from the CPU 102, it drives the actuator 4 to extend or contract for the time duration of the forward or backward signal received.

Figure 2:
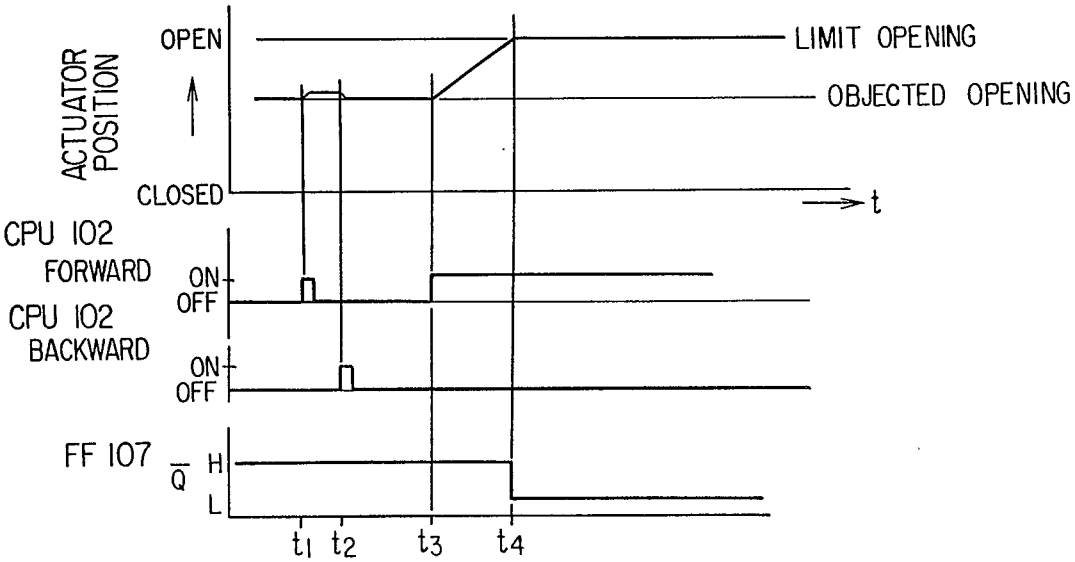

The operation of this embodiment as constructed above will now be described with reference to the time chart of FIG. 2. When the CPU 102 outputs a forward signal at time $t_1$, the actuator 4 is driven by the driver 103 to extend the actuator rod 5 (i.e., in the throttle valve opening direction) for a time corresponding to the duration of the forward signal, and subsequently when the CPU 102 outputs a backward signal at time $t_2$, the actuator 4 is driven to contract the actuator rod 5 (i.e., in the throttle valve closing direction). Such an operation of the actuator 4 is performed when the CPU 102 is operating in a normal manner. In this case, the extended position of the actuator rod 5 (i.e., the opening degree of the throttle valve 2) is within an upper limit determined by the limiting circuit 104 and hence there is not output signal of high level generated by the comparator 105 for limiting the extension of the actuator rod 5. Accordingly, the output level of the AND gate 106 is low so that the set terminal (S) of the flip-flop 107 is not set with the output level at the output terminal ($\overline{Q}$) being high. In this state, the forward signal from the CPU 102 is transmitted through the AND gate 108 to the driver 103 so that the driver 103 drives the actuator in the forward or extending direction.

On the other hand, suppose that there take place some kind of failure in the CPU 102 at time $t_3$ so that the CPU 102 continues to erroneously output a forward signal. In this case, if the actuator 4 is continuously driven to extend, the rotational speed of the engine will increase to a value above 4,000 rpm under to load in cases where the engine is under fast idling operation. However, when the voltage level of the output signal of the actuator position sensor 6 exceeds a predetermined upper limit, the comparator 105 outputs a forward or extension limiting signal (i.e., an output signal of high level) to the CPU 102 whereby the CPU 102 normally operates to immediately stop generation of the forward signal if it is generated. In spite of this, however, should the CPU 102 continue to output the forward signal, the output level at the output terminal of the AND gate 106 becomes high so that the set terminal (S) of the flip-flop 107 is set to make the output level at the output terminal ($\overline{Q}$) low. Consequently, the AND gate 108 is closed to interrupt the transmission of the forward signal from the CPU 102 toward the driver 103 whereby the actuator 4 is stopped at the limit position as determined by the limiting circuit 104 at time $t_4$, thus preventing a further increases in the rotational speed of the engine.

Here, it is to be noted that the flip-flop 107 is reset by the initialization circuit 109 when a power switch (not shown) is turned on so that the CPU 102 can perform the usual actuator position control.

Figure 3:
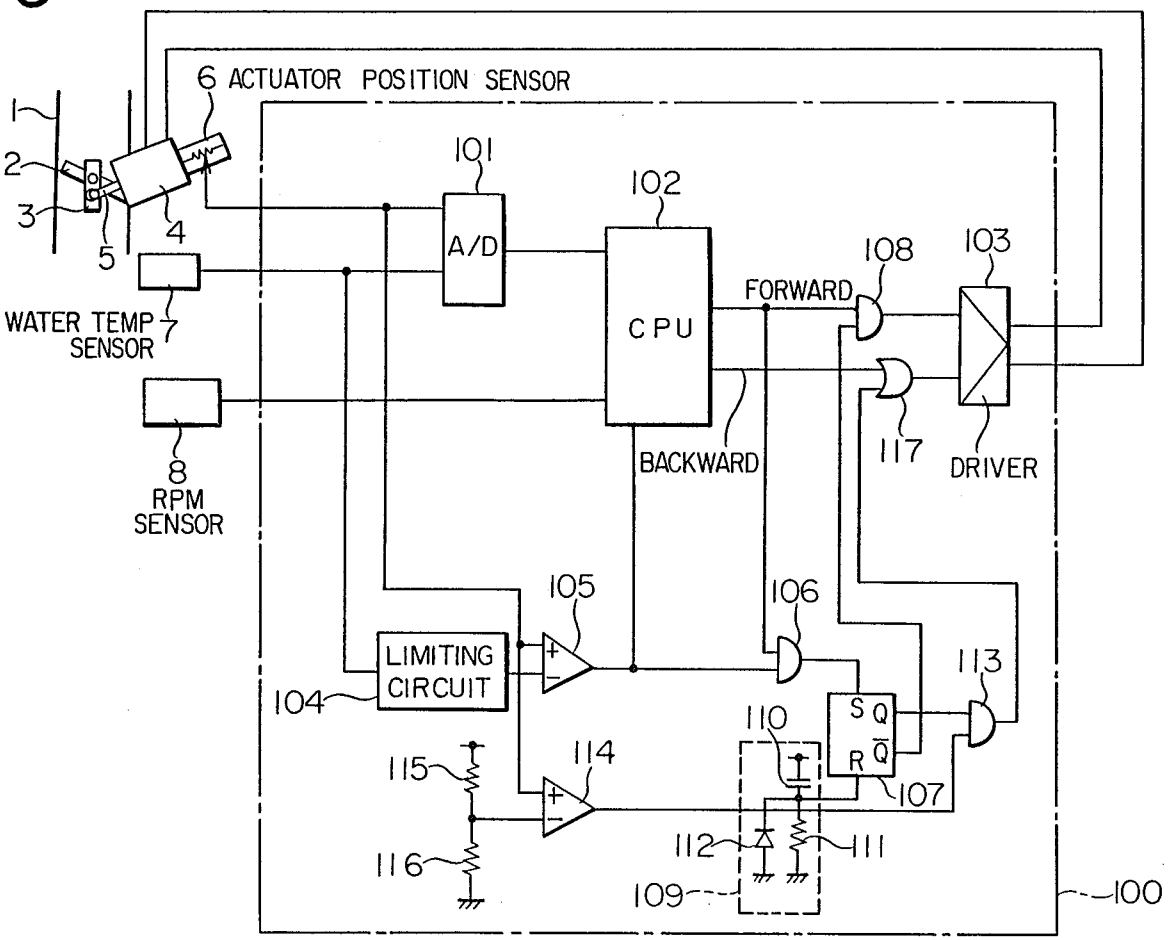

FIG. 3 illustrates another embodiment of the present invention which can perform more improved control of the idling operation of an internal combustion engine than that carried out by the previous embodiment illustrated in FIG. 1. This embodiment is similar to the previous embodiment except for the following features. The same or corresponding parts of this embodiment are identified by the same reference numerals as employed in the previous embodiment. Specifically, as shown in FIG. 3, the actuator position sensor 6 is also connected to one (+) of input terminals of a backward or contraction determining comparator 114 so that the output signal of the actuator position sensor 6 is input to the comparator 114. The other input terminal (−) of the comparator 114 is connected to a connection point between a pair of resistors 115 and 116 which serve to divide the voltage of a power source (not shown) so as to determine a backward or contraction level of the actuator 4 as a lower limit, as shown by broken line C in FIG. 5. The comparator 114 operates to compare the actual position of the actuator rod 5 as sensed by the actuator position sensor 6 with the lower limit and generate an output signal of high level when it is determined that the actual position of the actuator rod 5 is above the predetermined lower limit. The comparator 114 has an output terminal connected to one of input terminals of an AND gate 113 of which the other input terminal is connected to one (Q) of output terminals of the flip-flop 107 of which the other output terminal ($\overline{Q}$) is connected to one of input terminals of the AND gate 108 as in the previous embodiment of FIG. 1. The AND gate 113 has an output terminal connected to one of input terminals of an OR gate 117 of which the other input terminal is connected to the backward output port of the CPU 102. The OR gate 117 has an output terminal connected to one of input terminals of the driver 103. The remaining portions of this embodiment are similar in construction and operation to the corresponding portions of the embodiment of FIG. 1.

Figure 4:
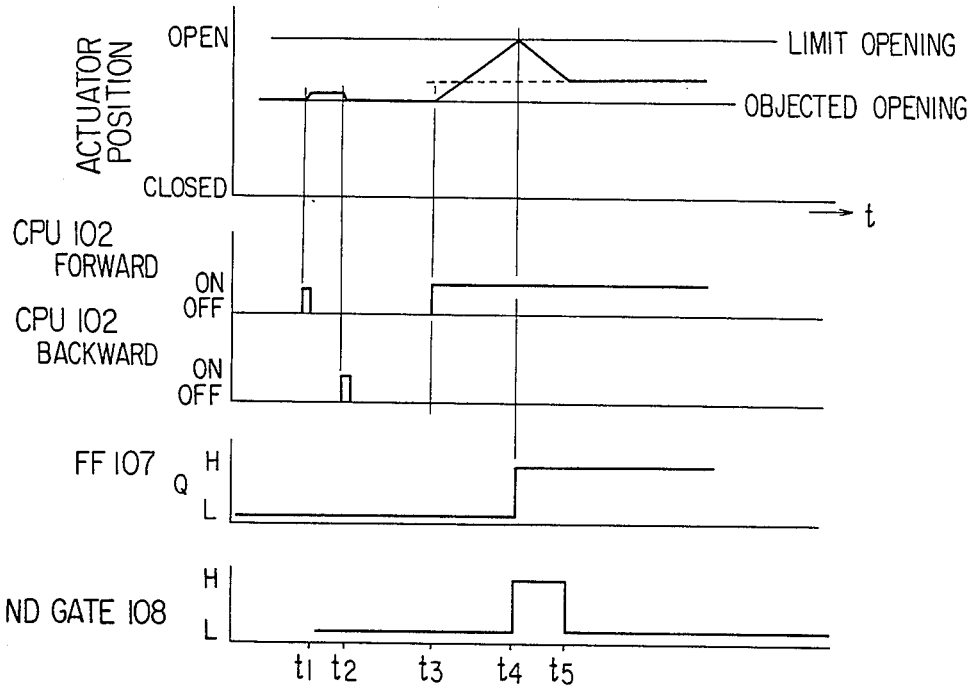

In operation of this embodiment, as illustrated in FIG. 4, the actuator 4 is operated by the CPU 102 in the same manner as in the previous embodiment of FIG. 1 until time $t_4$ at which the voltage of the output signal of the actuator position sensor 6 exceeds the upper limit determined by the limiting circuit 104. More specifically, at time $t_4$, the comparator 105 sends a forward or extension limiting signal (i.e., an output signal of high level) to the CPU 102 whereby the CPU 102 operates to immediately stop generation of a forward signal when it is generated. In spite of this, however, if the CPU 102 continues to output the forward signal, the output of the AND gate 106 becomes high so that the flip-flop 107 is set at the set terminal (S) to make the output level at the output terminal ($\overline{Q}$) low. As a result, the AND gate 108 is closed to interrupt transmission of the forward signal from the CPU 102 toward the driver 103 as previously described with references to FIG. 2. According to this embodiment, at this time, the output level at the output terminal (Q) of the flip-flop 107 becomes high, and the backward or contraction determining comparator 114 determines that the actual position of the actuator rod 5 as sensed by the actuator position sensor 6 is above the predetermined backward level or the lower limit determined by the voltage-dividing resistors 115 and 116, and generates an output signal of high level. As a result, the output level of the AND gate 113 becomes high and hence the output level of the OR Gate 117 is changed into the high level to send out a backward signal to the driver 103 whereby the actuator 4 is driven by the driver 103 to contract (i.e., in the closing direction of the throttle valve 2). Subsequently, when the position of the actuator rod 5 reaches a predetermined backward or contraction level (i.e., the lower limit) at time $t_5$, the output level of the comparator 114 becomes low to make the output level of the AND gate 113 low, thereby stopping the backward or contracting operation of the actuator 4. Thereafter, the actuator 4 continues to be held at the predetermined backward or contraction position until a key or ignition switch (not shown) is turned off, and when a power switch (not shown) is turned on, the flip-flop 107 is reset by the initialization circuit 109 to return the control device 100 to the initial condition in which the usual actuator position control can be performed.

In this regard, it is to be noted that the backward or contraction level of the actuator 4 is determined such that the opening degree of the throttle valve 2 is at such an appropriate value as to make the rotational speed of the engine at about 900 rpm in the neutral state of the change gear (not shown) in order to prevent engine stall under various loading conditions of the engine.

What is claimed is:

1. A device for controlling idling operation of an internal combustion engine comprising:

an engine RPM sensor which senses rotational speed in RPMs of an engine and generates an output signal representative thereof;

a water temperature sensor which senses temperature of cooling water for the engine and generates an output signal representative thereof;

a throttle valve in an intake passage of the engine which controls flow rate of intake air sucked into the engine;

an actuator means operatively connected to said throttle valve for controlling the opening degree of said throttle valve during the idling operation of the engine;

an actuator position sensor which senses an operating position of said actuator means and generates an output signal representative thereof;

a first control means connected to receive output signals from said engine RPM sensor, said water temperature sensor, and said actuator position sensor and calling for operation of said actuator means such that the opening degree of said throttle valve is adjusted to maintain the RPMs of the engine during idling at a predetermined value corresponding to the sensed temperature of the cooling water; and a second control means operable independently of said first control means to control the operation of said actuator means in accordance with the operating position of said actuator means and the temperature of the cooling water so as to limit the operating position of said actuator means and thereby limit the RPMs of the engine to the predetermined value corresponding to the sensed temperature of the cooling water notwithstanding a higher value of RPMs being called for by said first control means.

2. A device for controlling idling operation of an internal combustion engine comprising:

an engine RPM sensor which senses rotational speed in RPMs of an engine and generates an output signal representative thereof;

a water temperature sensor which senses temperature of cooling water for the engine and generates an output signal representative thereof;

a throttle valve in an intake passage of the engine which controls flow rate of intake air sucked into the engine;

an actuator means operatively connected to said throttle valve for controlling the opening degree of said throttle valve during the idling operation of the engine;

an actuator position sensor which senses an operating position of said actuator means and generates an output signal representative thereof;

a control means connected to receive output signals from said engine RPM sensor, said water temperature sensor, and said actuator position sensor and calling for operation of said actuator means such that the opening degree of said throttle valve is adjusted to maintain the RPMs of the engine during idling at a predetermined value corresponding to the sensed temperature of the cooling water;

a position-limiting means connected to receive output signals from said water temperature sensor and said actuator position sensor to generate a first limit signal to said control means when the operating position of said actuator position sensor exceeds a first predetermined value and a second limit signal when the operating position of said actuator position sensor exceeds a second predetermine value; and an actuator-limiting means operatively connected to said position-limiting means for generating a first control signal to stop the operation of said actuator means in a forward, increased-speed direction on the basis of said first limit signal and for generating a second control signal to stop the operation of said actuator means in a backward, decreased-speed direction on the basis of said second limit signal.

3. A device for controlling idling operation of an internal combustion engine according to claim 1 wherein said second control means includes:

a position-limiting means connected to receive output signals from said water temperature sensor and said actuator position sensor to generate a limit signal to said first control means when the operating position of said actuator position sensor exceeds a predetermined value; and an actuator-stopping means operatively connected to said position-limiting means for generating a control signal to stop the operation of said actuator means on the basis of said limit signal.

* * * * *